US006101853A

United States Patent [19]

Herr

[11] Patent Number: 6,101,853

[45] Date of Patent: Aug. 15, 2000

[54] DOOR AND LATCH MECHANISM

[75] Inventor: Devon L. Herr, Nappanee, Ind.

[73] Assignee: Monaco Coach Corporation, Wakarusa, Ind.

[21] Appl. No.: 09/221,905

[22] Filed: Dec. 28, 1998

[51] Int. Cl.[7] ..... E05B 59/00

[52] U.S. Cl. ..... 70/109; 70/208; 209/36; 209/216; 209/336.3

[58] Field of Search ..... 70/107–110, 208; 292/32–37, 99, 113, 126, 216, 336.3, DIG. 3, DIG. 23, DIG. 31, DIG. 43

[56] References Cited

U.S. PATENT DOCUMENTS

| | | | |
|---|---|---|---|
| D. 346,731 | 5/1994 | Larsen et al. | D8/301 |
| D. 369,084 | 4/1996 | McConnell et al. | D8/302 |
| D. 369,089 | 4/1996 | Zenner | D8/343 |
| D. 371,500 | 7/1996 | McConnell et al. | D8/302 |
| D. 373,298 | 9/1996 | Miehe et al. | D8/302 |
| 3,065,986 | 11/1962 | Barker et al. | 292/99 X |
| 3,582,120 | 6/1971 | Doerr | 292/36 |
| 3,679,251 | 7/1972 | Brockman et al. | 292/216 |
| 3,844,595 | 10/1974 | Meinow | 292/216 |
| 3,899,202 | 8/1975 | Pickles | 292/216 |
| 4,379,360 | 4/1983 | Papsdorf | 29/11 |
| 4,689,976 | 9/1987 | Larsen | 70/208 |
| 4,762,349 | 8/1988 | Ikeda | 292/216 |
| 4,773,683 | 9/1988 | Nakamura | 292/216 |
| 4,775,176 | 10/1988 | Ikeda | 292/216 |
| 4,892,338 | 1/1990 | Weinerman et al. | 292/DIG. 31 X |
| 4,917,412 | 4/1990 | Swan et al. | 292/216 X |
| 4,951,486 | 8/1990 | Braun et al. | 70/208 |
| 5,042,853 | 8/1991 | Gleason et al. | 292/126 |
| 5,046,769 | 9/1991 | Rimbey et al. | 292/216 |
| 5,058,937 | 10/1991 | Miehe et al. | 292/34 |
| 5,127,686 | 7/1992 | Gleason et al. | 292/216 |
| 5,234,237 | 8/1993 | Gergoe et al. | 292/336.3 X |
| 5,299,844 | 4/1994 | Gleason | 292/240 |
| 5,308,130 | 5/1994 | Lee | 292/336.3 |
| 5,360,244 | 11/1994 | Gleason et al. | 292/167 |
| 5,382,060 | 1/1995 | O'Toole et al. | 292/336.3 X |
| 5,410,899 | 5/1995 | McConnell | 70/370 |
| 5,595,076 | 1/1997 | Weinerman et al. | 70/208 |
| 5,603,234 | 2/1997 | Lozier et al. | 292/36 X |
| 5,606,882 | 3/1997 | Larsen et al. | 70/369 |
| 5,618,068 | 4/1997 | Mitsui et al. | 292/216 X |
| 5,718,465 | 2/1998 | Dowling et al. | 292/DIG. 23 X |
| 5,749,611 | 5/1998 | Watson et al. | 292/DIG. 23 X |
| 5,769,471 | 6/1998 | Suzuki et al. | 292/216 X |
| 5,899,508 | 5/1999 | Cetnar et al. | 292/216 |
| 5,951,069 | 9/1999 | Kobayashi et al. | 292/216 X |

FOREIGN PATENT DOCUMENTS

| | | | |
|---|---|---|---|
| 112574 | 4/1990 | Japan | 70/208 |

OTHER PUBLICATIONS

Tri/Mark advertising brochure for 100–5000 System, Vehicle Door Hardware.

*Primary Examiner*—Suzanne Dino Barrett
*Attorney, Agent, or Firm*—Barnes & Thornburg

[57] ABSTRACT

A latch mechanism for a door has first and second latches, a handle, a first cam connected to the first and second latches, a second cam and a third cam connected to the handle such that movement of the handle operates the first and second latches by transmitting movement from the third cam to the first cam through the second cam. One or more rods may be used to connect the latches and or handle. The first handle may simultaneously operate the first and second latches. A second handle may also be provided for simultaneously operating the latches. The first cam includes a finger and the second cam includes a projection that is selectively engageable with the finger. Movement of the third cam causes movement of the projection which in turn causes movement of the first cam when the projection is engaged with the finger of the first cam. The first and second latches may be locked by disengaging the projection and the finger.

37 Claims, 9 Drawing Sheets

DOOR AND LATCH MECHANISM

BACKGROUND AND SUMMARY OF THE INVENTION

The present invention relates to a latch mechanism and, in particular, to latch mechanisms for doors.

Various latches are known for securing doors in a closed position. Some latch mechanisms are provided with locking devices to secure the door against unwanted entry.

The present invention provides a latch mechanism for a door having first and second latches, a handle, a first cam connected to the first and second latches, a second cam and a third cam connected to the handle such that movement of the handle operates the first and second latches by transmitting movement from the third cam to the first cam through the second cam. One or more rods may be used to connect the latches and or handle. The first handle may simultaneously operate the first and second latches.

In one embodiment of the invention, the mechanism may also include a lock that selectively engages and disengages the first and second cams.

In another embodiment, the third cam includes an opening and the second cam includes a projection located at least partially within the opening. The second cam includes first and second surfaces and the projection extends from beyond the first surface to beyond the second surface.

In another embodiment, the first cam includes a finger and the second cam includes a projection that is selectively engageable with the finger. Movement of the third cam causes movement of the projection which in turn causes movement of the first cam when the projection is engaged with the finger of the first cam. The first and second latches may be locked by disengaging the projection and the finger.

In another embodiment, the latch mechanism further including a second handle connected to the third cam such that movement of the second handle operates the first and second latches by transmitting movement from the third cam to the first cam through the second cam. The second handle may simultaneously operate the first and second latches In yet another embodiment, a lock is positioned between the first and second latches.

According to another embodiment of the present invention, a latch mechanism for a door includes a first latch, a second latch and means for simultaneously operating the first and second latches. The means may include a plurality of cams, handles and/or rods.

Other features of the present invention will be apparent from the following description of the embodiments and the accompanying drawings.

DETAILED DESCRIPTION OF THE EMBODIMENTS OF THE INVENTION

Figure 1:
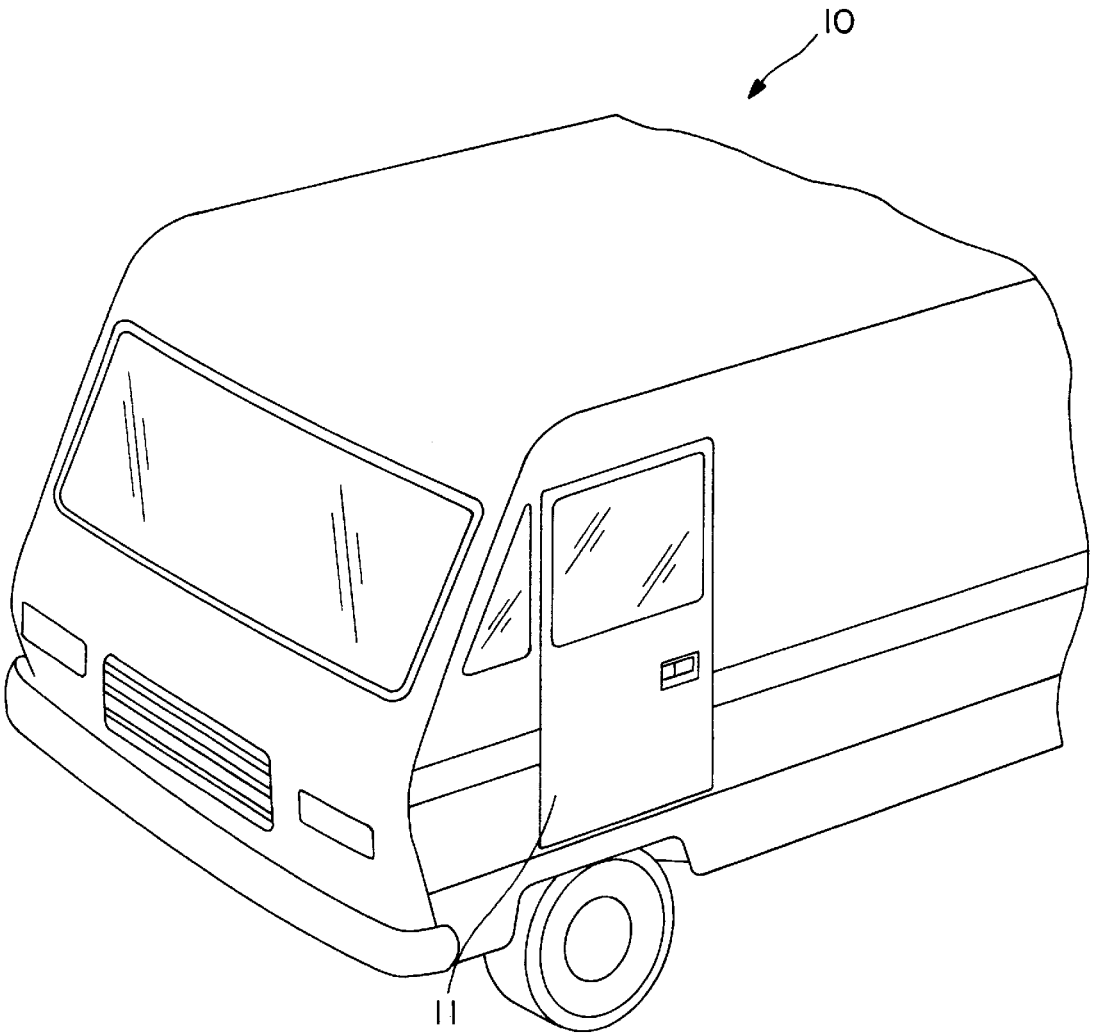
FIG. 1 is a partial perspective view of, for example, a recreational vehicle having a door including a latch mechanism according to the present invention.

FIG. 1 is a partial perspective view of, for example, a recreational vehicle 10 including a door 11 employing a latch mechanism according to the present invention.

Figure 2:
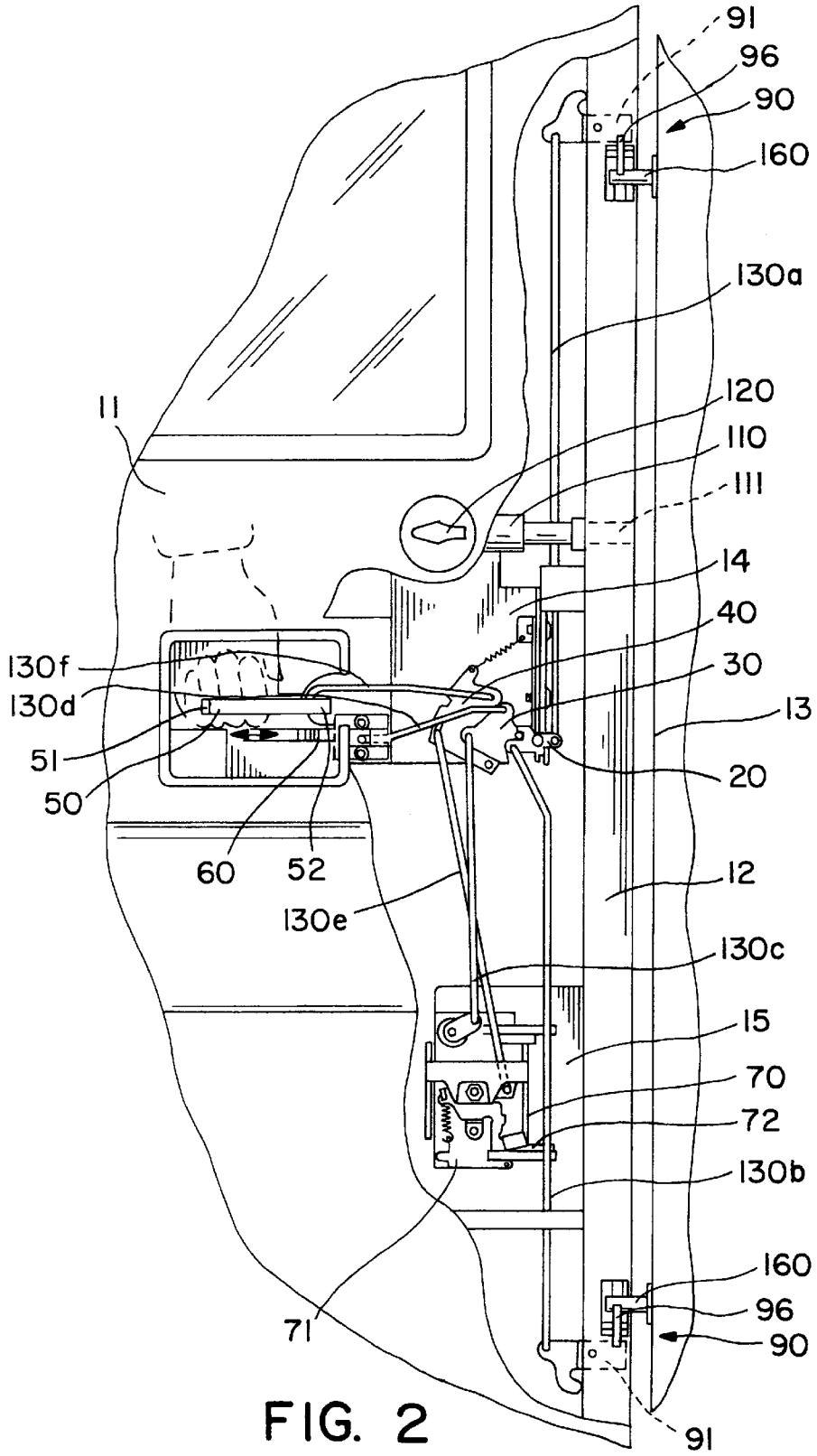
FIG. 2 is a partial cut-away view of the door shown in FIG. 1 illustrating a latch mechanism according to one embodiment of the present invention in the closed and unlocked position.

FIG. 2 is a partial cut-away view of the door shown in FIG. 1 illustrating the components of a latch mechanism according to one embodiment of the present invention in the latched position. The door includes a first frame member 12 and a second frame member 13. The latch mechanism generally includes a first cam 20, a second cam 30, a third cam 40, a first handle 50, a first lock 60, a second handle 70, a second lock 80, a first and second latches 90, a third latch 110, a third lock 120, and a plurality of connecting rods 130*a–j*.

First cam 20 (FIG. 3) includes a first surface 21, a second surface 22, a first finger 23, a second finger 24 and a third finger 25. Second finger 24 is offset from and extends above first surface 21. The arrangement of second finger 24 and third finger 25 leaves a space 26 located between second finger 24 and third finger 25. First finger 23 is provided with an opening 23*a*. Second finger 24 is similarly provided with an opening 24*a*. Another opening 27 is formed through first surface 21 and second surface 22.

Second cam 30 (FIG. 3) includes a first surface 31 and a second surface 32. A projection 33 extends above first surface 31 and below second surface 32, so that projection 33 extends farther beyond the first surface 31 than the second surface 32. Second cam 30 further includes a first finger 34 and a second finger 35 arranged such that there is a space 36 between fingers 34 and 35. Second cam 30 further includes a plurality of openings 31*a–d* extending through first surface 31 and second surface 32 of second cam 30.

Third cam 40 (FIG. 3) includes a first surface 41 and a second surface 42. Third cam 40 further includes a first finger 43, a second finger 44, a third finger 45 and a fourth finger 46. Second, third and fourth fingers 44, 45 and 46 are located on a raised portion of third cam 40 above first surface 41. Third finger 45 includes an upturned end 47 that extends above the remainder of third finger 45, second finger 44 and fourth finger 46. Second finger 44 and third finger 45 are arranged so as to provide a space 48 therebetween. In similar fashion, third finger 47 and fourth finger 46 are positioned so as to leave a space 49 therebetween. A plurality of openings 41*a–e* extend through first surface 41 and second surface 42 of third cam 40. An opening 44*a* extends through second finger 44. Similarly, another opening 45*a* extends through third cam 40 near second finger 44 and third finger 45. Openings 46*a* and 46*b* extend through fourth finger 46.

Figure 3:
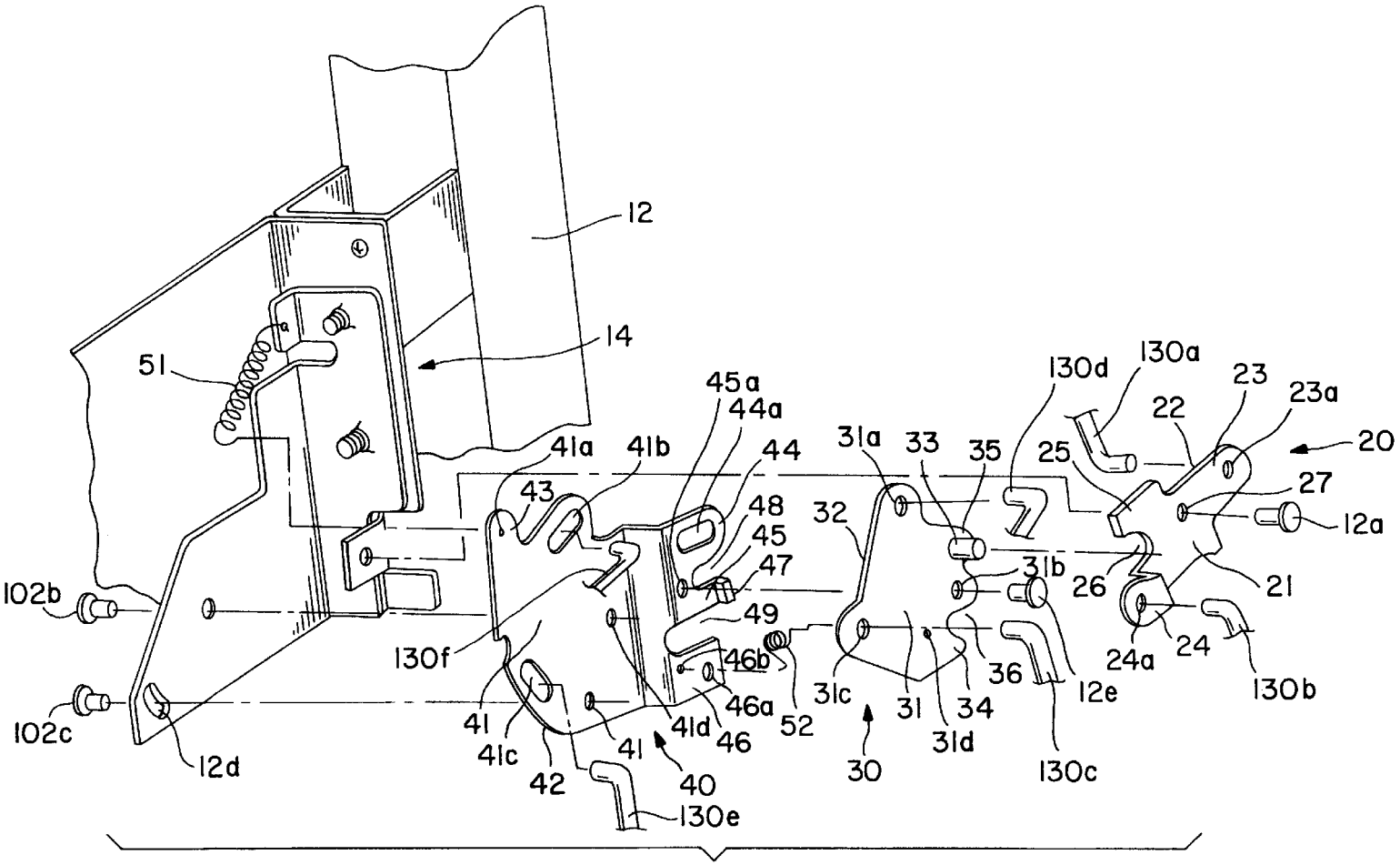
FIG. 3 is an exploded view showing three cams that are components of the latch mechanism shown in FIG. 2.
Figure 4:
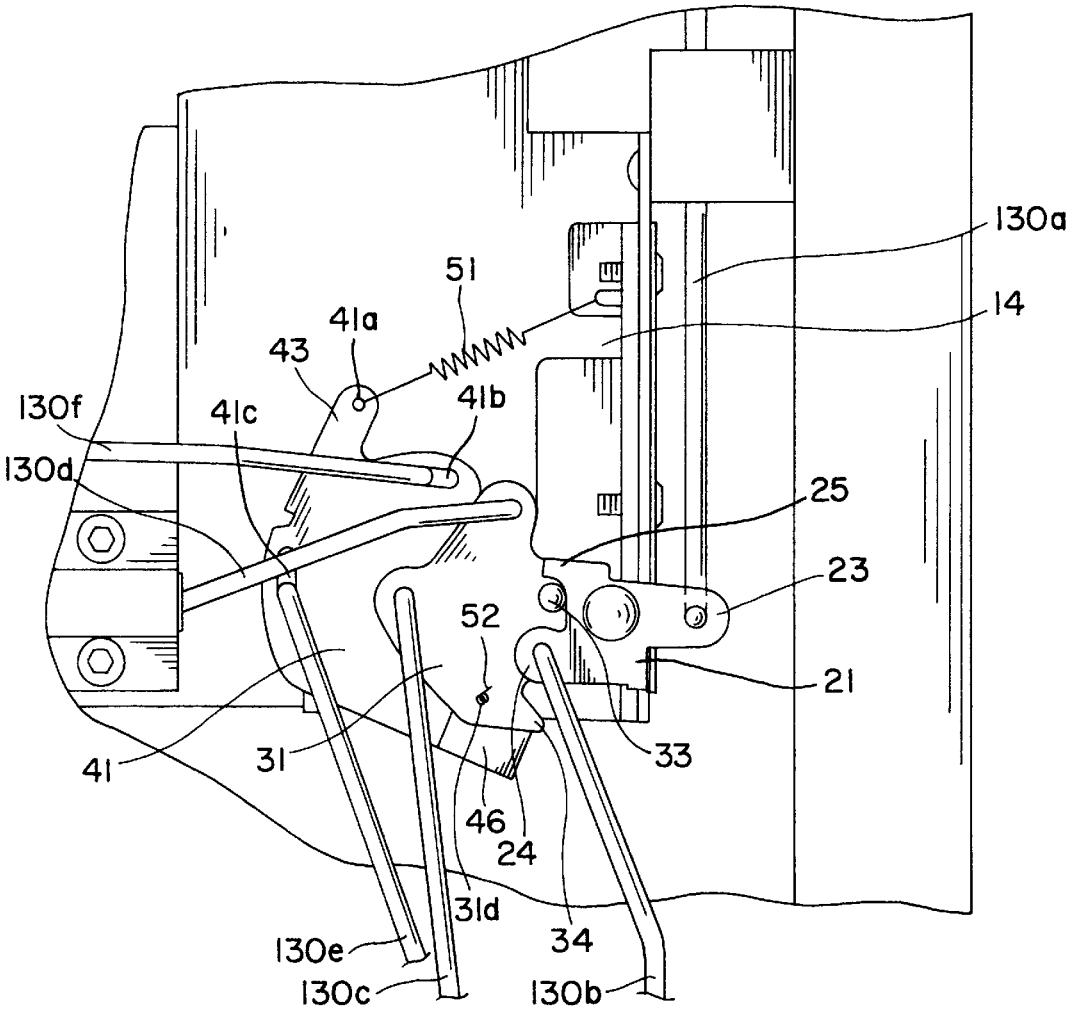
FIG. 4 is a front elevational view of the cams of FIG. 3 in their operational positions.

As shown in FIGS. 2 through 4, cams 20, 30 and 40 are secured to frame member 12 through a bracket assembly 14. In the embodiment shown, first cam 20 is secured to bracket assembly 14 by inserting a screw, rivet or similar fastener 12*a* through opening 27 and into bracket assembly 14. Note that first cam 20 must be secured in such a manner that first cam 20 may rotate about fastener 12*a*. In a similar fashion, third cam 40 is secured to bracket assembly 14 by inserting fasteners 12*b* and 12*c* through openings 41*d* and 41*e*. Note that the opening 12*d* through which fastener 12*c* extends is elongated such that as third cam 40 pivots about fastener 12*b*, fastener 12*c* moves within that opening.

Second cam 30 is positioned such that a portion of projection 33 is located in space 26 between second finger 24 and third finger 25 of cam 20 and end 47 of third finger 45 is located in space 36 between fingers 34 and 35 of second cam 30. In this position, extension 33 extends through opening 44*a* in third cam 40. A fastener 12*e* is inserted through opening 31*b* in second cam 30 and into opening 45*a* in third cam 40.

A first spring s1 is secured at one end to bracket assembly 14 and at the other end to third cam 40 by inserting through opening 41*a* as shown. A second spring s2 is connected at one end to cam 30 by inserting through opening 31*d* and at the other end to third cam 40 by inserting through opening 46*b* as shown.

First handle 50 (FIG. 2), in the embodiment shown, is secured to bracket assembly 14 so as to include a free end 51 and a pivoting end 52. Lock 60 is located below first handle 50. As described in further detail below, lock 60 is operated by sliding it in the directions indicated by the arrows.

Figure 5:
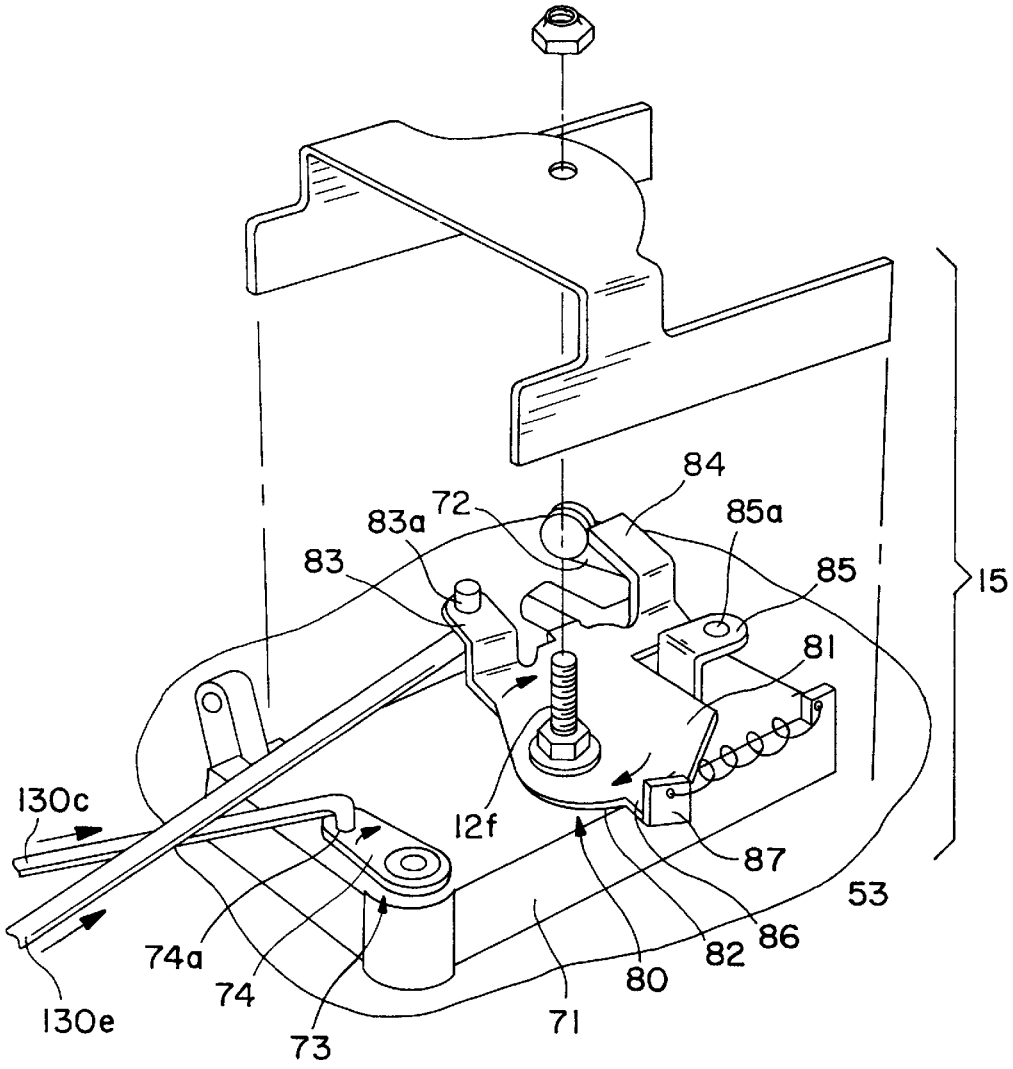
FIG. 5 is an exploded view showing a handle and cam that are components of the latch mechanism shown in FIG. 2.

Turning to FIG. 5, second handle 70, in the embodiment shown, is a paddle-type handle pivotally secured to a housing 71. Housing 71 is in turn secured to frame member 12 by a bracket assembly 15. Handle 70 includes a finger 72 secured to one end thereof. A cam 80 is secured to the housing 71.

Cam 80 includes a first surface 81, a second surface 82, a first finger 83, a second finger 84, a third finger 85, and a fourth finger 86. First finger 83, second finger 84, and third finger 85 are offset and raised above first surface 81. Fourth finger 86 includes an upturned end 87 extending substantially vertically from first surface 81. An opening 81*a* is formed through first surface 81 and second surface 82. Openings 83*a* and 85*a* are formed in first finger 83 and second finger 85, respectively. An opening 87*a* is formed in upturned end 87 of third finger 86. Fourth cam 80 is attached to housing 71 by inserting a fastener 12*f* through housing 71 and opening 81*a*. Cam 80 is secured to housing 71 so as to be able to rotate about fastener 12*f*. One end of a spring s3 is secured to upturned end 87 through opening 87*a* as shown and the other end is secured to housing 71 as shown. Cam 80 is positioned such that finger 72 of handle 70 contacts second finger 84 of cam 80. A lock assembly 73 is secured to housing 71 and includes a finger 74 extending therefrom having opening 74*a* therein.

Figure 7:
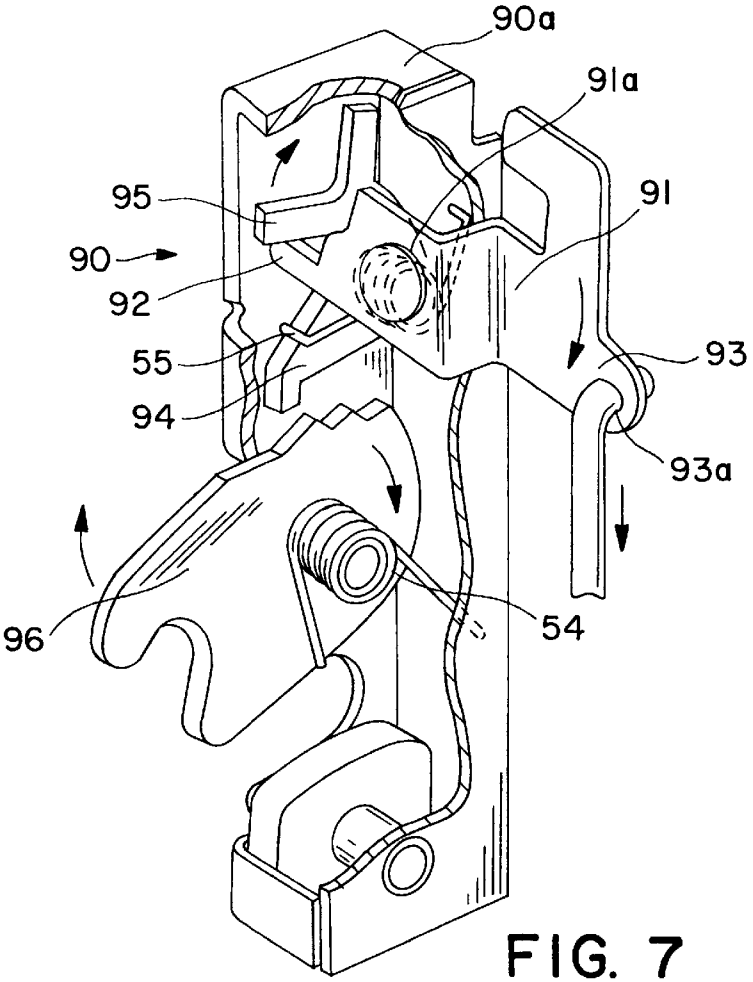
FIG. 7 is a partial cut-away view of a latch assembly that is a component of the latch mechanism shown in FIG. 2 in the open position.
Figure 6:
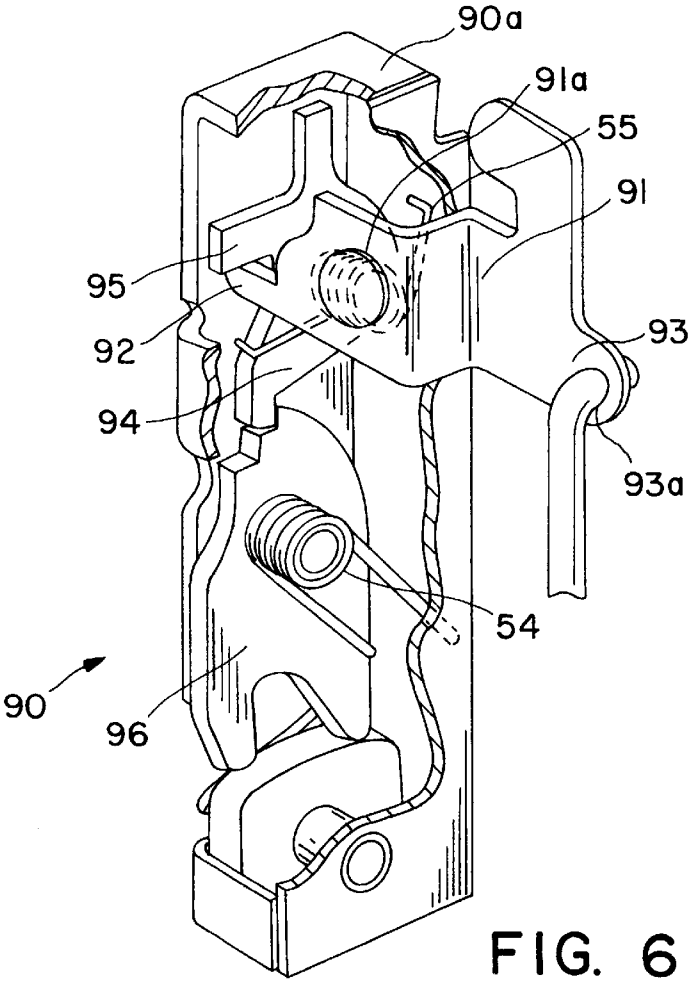
FIG. 6 is a partial cut-away view of a latch assembly that is a component of the latch mechanism shown in FIG. 2 in the latched position.
Figure 8:
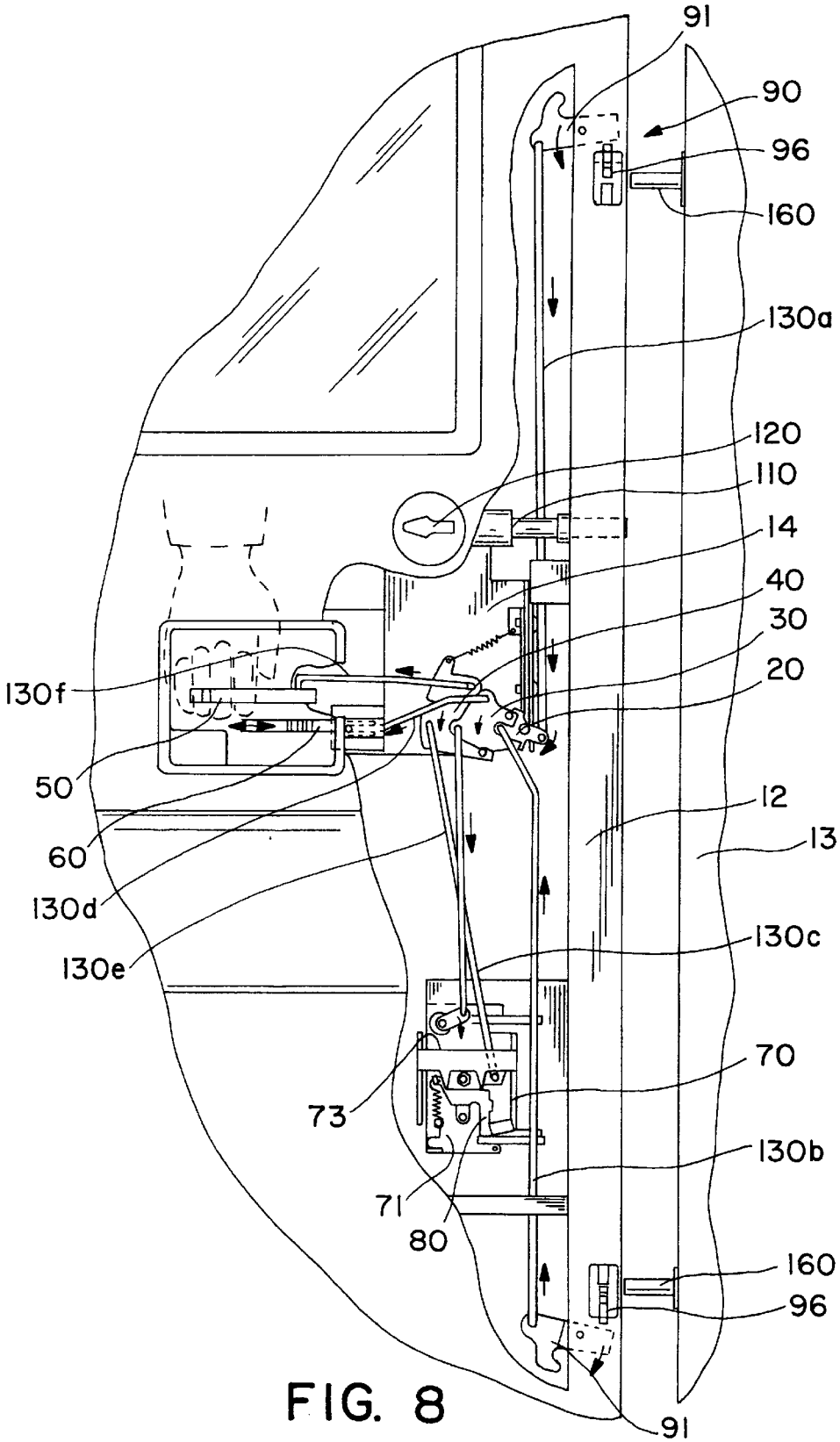
FIG. 8 is a partial cut-away view illustrating the latch mechanism of FIG. 2 being opened by operation of a first handle.
Figure 9:
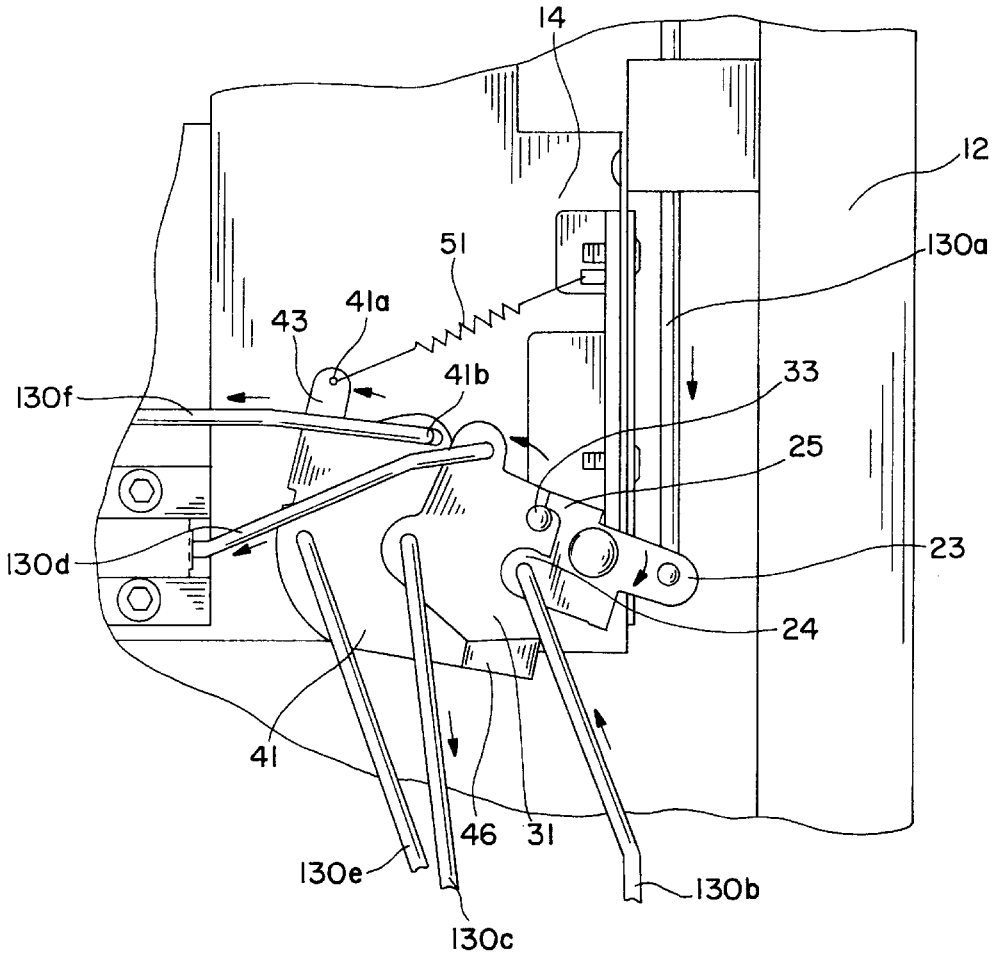
FIG. 9 illustrates the movement of the cams shown in FIG. 3 when the first handle is operated as shown in FIG. 8.

Latches 90 (FIGS. 6 and 7), in the embodiment shown, each include housing 90*a*. Each latch 90 further includes a cam member 91 having a first finger 92 and a second finger 93 with an opening 93*a* therein. Cam 91 is pivotally connected to frame member 13 by a fastener 91*a* extending through opening. Latch 90 further includes a pawl 94 pivotally connected to housing 90*a*. Pawl 94 includes a finger 95 in contact with finger 92 on cam 91. Latch 90 further includes a catch 96. Catch 96 is notched for engaging pawl 94 as shown. Both catch 96 and pawl 94 are pivotally attached to housing 90*a*. Catch 96 and pawl 94 are biased by springs s4 and s5. In particular, spring s4 biases catch 96 into the open position as shown in FIG. 7. Spring s5 biases pawl 94 downward as shown in FIG. 6.

The various components described above are connected by a plurality of connecting rods 130*a*–130*f*. Connecting rod 130*a* engages opening 93*a* of one cam 91 and opening 23*a* of cam 20. Connecting rod 130*b* engages opening 24*a* of cam 20 and opening 93*a* of the other cam 91. Connecting rod 130*c* engages opening 31*c* of cam 30 and opening 74*a* of finger 74. Connecting rod 130*d* engages opening 31*a* of cam 30 and is attached at the other end to lock 60. Connecting rod 130*e* engages opening 41*c* of cam 40 and opening 83*a* of cam 80. Connecting rod 130*f* engages opening 41*b* of cam 40 and pivotal end 52 of handle 50.

FIG. 2 shows the door in the latched but unlocked position. In this position, each catch 96 engages a post 160 attached to frame member 13. Lock 60 is positioned such that projection 33 engages finger 25 of cam 20. To open the door (FIGS. 2, 7, 8 and 9), handle 50 is pivoted such that connecting rod 130*f* pulls on cam 40, causing it to rotate in a counter-clockwise direction. As cam 40 rotates in a counter-clockwise direction, end 47 of finger 45 on cam 40 engages finger 35 on cam 30, also causing it to rotate in a counter-clockwise direction. As cam 30 rotates in a counter-clockwise direction, projection 33 bears against finger 25 of cam 20 causing cam 20 to rotate in a clockwise direction. As cam 20 rotates in a clockwise direction, connecting rod 130*a* is pulled downward and connecting rod 130*b* is pulled upward. This causes cams 96 to rotate. As cams 96 rotate, fingers 92 cause pawls 94 to rotate out of engagement from the notched portion of catches 96. The biasing force of spring s4 causes catches 96 to rotate out of engagement with posts 160.

Figure 10:
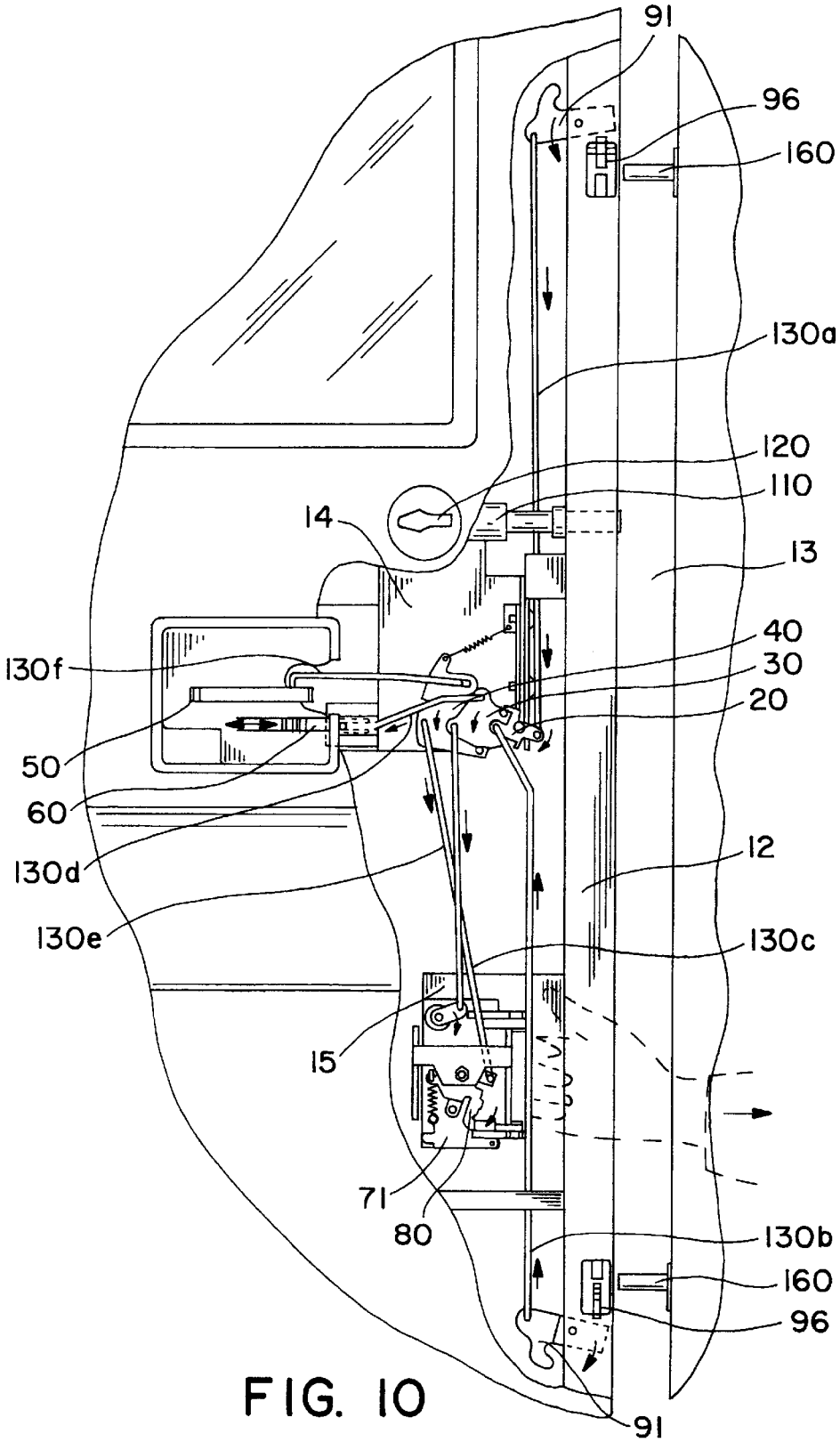
FIG. 10 is a partial cut-away view illustrating the latch mechanism of FIG. 2 being opened by operation of a second handle.

Door 11 may also be operated by pivoting handle 70 (FIG. 10). As this occurs, finger 72 engages finger 84 of cam 80 and causes it to rotate in a clockwise direction. As this occurs, movement of cam 80 applies a downward force to connecting rod 130 thereby causing cam 40 to rotate in a counterclockwise direction. This movement of cam 40 disengages catches 96 from posts 160 as described above.

The door 11 may be locked in several ways. First, lock 60 can be used to disengage projection 33 from finger 25. To do so, lock 60 is slid away from cam 30. This causes connecting rod 130*d* to move cam 30 such that projection 33 is no longer engaged with finger 25. Accordingly, if either handle is then operated, although cams 40 and 30 will rotate, cam 20 will remain stationary and the door will remain latched. Similarly, using a key to lock the door via lock 80 causes connecting rod 130*c* to move cam 30 such that projection 33 no longer engages finger 25. Again, operating either handle will cause cams 40 and 30 to rotate, but cam 20 will remain stationary. A third way to lock the door is via lock 120. Lock 120 is a dead bolt type lock. When the lock is engaged, dead bolt 110 extends into frame member 13. In this manner, even if locks 60 and 80 are unlocked, thereby allowing operation of latches 90, the door may not be opened due to the engagement of dead bolt 110 frame member 13.

The preceding description is to be taken by way of illustration only and not by way of limitation. Various modifications can be made to the embodiment described without departing from the scope of the invention. For example, various latches and components thereof can be substituted for those of latches 90 in the embodiment illustrated. The various cams can also be of different configurations than those shown. Accordingly, the scope of the present invention is to be limited only by the terms of the appended claims.

What is claimed is:

1. A latch mechanism for a door assembly including a door and frame, the latch mechanism comprising:

first and second latches a handle;

a bracket assembly coupled to the frame;

a first cam pivotally coupled to the bracket assembly by a first fastener and connected to the first and second latches;

a second cam; and a third cam pivotally coupled to the bracket assembly by a second fastener and connected to the handle such that movement of the handle operates the first and second latches by transmitting movement from the third cam to the first cam through the second can, the second cam being positioned between the first and third cams.

2. The latch mechanism according to claim 1, further including at least one rod connecting the first cam to at least one of the latches.

3. The latch mechanism according to claim 1, further including at least one rod connecting the handle to the third cam.

4. The latch mechanism according to claim 1, further including a lock.

5. The latch mechanism according to claim 4, wherein the lock selectively engages and disengages the first and second cams.

6. The latch mechanism according to claim 1, wherein the third cam includes an opening and the second cam includes a projection located at least partially within the opening.

7. The latch mechanism according to claim 6, wherein the projection moves within the opening.

8. The latch mechanism according to claim 6, wherein the second cam includes first and second surfaces and the projection extends from beyond the first surface to beyond the second surface.

9. The latch mechanism according to claim 8, wherein the projection extends farther beyond the first surface than the second surface.

10. The latch mechanism according to claim 1, wherein the first cam includes a finger and the second cam includes a projection that is selectively engageable with the finger.

11. The latch mechanism according to claim 10, wherein movement of the third cam causes movement of the projection which in turn causes movement of the first cam when the projection is engaged with the finger of the first cam.

12. The latch mechanism according to claim 11, wherein the third cam includes an opening and the projection is located at least partially within the opening.

13. The latch mechanism according to claim 12, wherein the projection moves within the opening.

14. The latch mechanism according to claim 10, wherein the first and second latches are locked by disengaging the projection and the finger.

15. The latch mechanism according to claim 1, further including a second handle connected to the third cam such that movement of the second handle operates the first and second latches by transmitting movement from the third cam to the first cam through the second cam.

16. The latch mechanism according to claim 15, wherein the second handle is connected to the third cam by a rod.

17. The latch mechanism according to claim 16, wherein a portion of the rod extends through an opening in the third cam.

18. The latch mechanism according to claim 17, wherein the rod moves within the opening in the third cam when the latches are operated by motion of the first handle.

19. The latch mechanism according to claim 1, wherein the first cam includes a first finger connected to the first latch and a second finger connected to the second latch.

20. The latch mechanism according to claim 19, wherein a plurality of rods connect the first and second fingers and latches.

21. The latch mechanism according to claim 1, further including a lock positioned between the first and second latches.

22. The latch mechanism according to claim 1, wherein the first handle simultaneously operates the first and second latches.

23. The latch mechanism according to claim 15, wherein the second handle simultaneously operates the first and second latches.

24. The latch mechanism according to claim 1, wherein operating the handle causes the first cam to rotate in one direction and the second and third cams to rotate in another direction.

25. The latch mechanism according to claim 24, wherein the second and third cams rotate in a direction opposite from the first cam.

26. A latch mechanism for a door assembly including a door and frame, the latch mechanism including:

first and second latches;

first and second handles;

first and second locks;

a first cam pivotally coupled to the bracket assembly by a first fastener and connected to the first and second latches;

a second cam connected to the first and second locks; and a third cam pivotally coupled to the bracket assembly by a second fastener and connected to the first and second handles, the second cam being positioned between the first and third cams.

27. The latch mechanism according to claim 26, wherein operating either of the handles simultaneously operates the first and second latches.

28. The latch mechanism according to claim 26, wherein operating either lock selectively locks and unlocks the first and second latches.

29. The latch mechanism according to claim 26, wherein the second cam is located between the first and third cams.

30. The latch mechanism according to claim 26, wherein the second cam includes a projection extending into an opening in the third cam.

31. The latch mechanism according to claim 26, wherein the second cam includes a projection engaging a finger on the first cam.

32. The latch mechanism according to claim 26, wherein the first cam is connected to the first and second latches by rods.

33. The latch mechanism according to claim 26, wherein the second cam is connected to the first and second locks by rods.

34. The latch mechanism according to claim 26, wherein the third cam is connected to the first and second handles by rods.

35. The latch mechanism according to claim 26, wherein the first cam includes a finger, the second cam includes a projection, and operating either lock selectively engages and disengages the projection and finger.

36. The latch mechanism according to claim 26, wherein operating the second handle causes the first cam to rotate in one direction and the second and third cams to rotate in another direction.

37. The latch mechanism according to claim 36, wherein the second and third cams rotate in a direction opposite from the first cam.

* * * * *